US011160326B2

(12) United States Patent
Bramani

(10) Patent No.: US 11,160,326 B2
(45) Date of Patent: Nov. 2, 2021

(54) COMPONENT SHOE

(71) Applicant: Vibram S.p.A., Albizzate (IT)

(72) Inventor: Marco Bramani, Milan (IT)

(73) Assignee: VIBRAM S.P.A., Albizzate (IT)

( * ) Notice: Subject to any disclaimer, the term of this patent is extended or adjusted under 35 U.S.C. 154(b) by 0 days.

(21) Appl. No.: 16/614,289

(22) PCT Filed: Apr. 19, 2018

(86) PCT No.: PCT/IB2018/052729
§ 371 (c)(1),
(2) Date: Nov. 15, 2019

(87) PCT Pub. No.: WO2018/211342
PCT Pub. Date: Nov. 22, 2018

(65) Prior Publication Data

US 2020/0268100 A1 Aug. 27, 2020

(30) Foreign Application Priority Data

May 17, 2017 (IT) ..... 102017000053475

(51) Int. Cl.

| | |
|---|---|
| ***A43B 3/24*** | (2006.01) |
| ***A43B 13/36*** | (2006.01) |
| *A43B 1/00* | (2006.01) |
| *A43B 13/26* | (2006.01) |

(52) U.S. Cl.
CPC ..... *A43B 13/36* (2013.01); *A43B 3/244* (2013.01); *A43B 1/0081* (2013.01); *A43B 3/242* (2013.01); *A43B 3/246* (2013.01); *A43B 13/26* (2013.01)

(58) Field of Classification Search
CPC ..... A43B 3/24; A43B 3/242; A43B 3/244; A43B 3/246; A43B 3/248
USPC ..... 36/15, 100, 101
See application file for complete search history.

(56) References Cited

U.S. PATENT DOCUMENTS

| | | | | |
|---|---|---|---|---|
| 2,119,392 A * | 5/1938 | Levin | A43B 3/24 | 36/12 |
| 2,200,080 A * | 5/1940 | Fein | A43B 3/24 | 36/101 |
| 2,297,594 A * | 9/1942 | Weinstat | A43B 3/122 | 36/19.5 |
| 2,407,556 A * | 9/1946 | Kleven | A43B 3/10 | 36/12 |
| 2,417,776 A * | 3/1947 | Neunuebel | A43B 3/10 | 36/12 |

(Continued)

FOREIGN PATENT DOCUMENTS

| | | |
|---|---|---|
| DE | 2523299 | 12/1976 |
| WO | 2014071964 | 5/2014 |

OTHER PUBLICATIONS

International Search Report for PCT/IB2018/052759 dated Jun. 29, 2018, 2 pages.

*Primary Examiner* — Marie D Bays
(74) *Attorney, Agent, or Firm* — Tutunjian & Bitetto, P.C.

(57) ABSTRACT

Footwear including a sole and an upper, wherein the sole includes a bottom surface, suitable for contacting the ground during use, and a sidewall that extends from the bottom surface and is placed at the outer periphery of the sole, wherein the upper is removable attachable to the sole whereby obtaining the footwear. The present invention further discloses a method for assembling the footwear.

15 Claims, 5 Drawing Sheets

(56) References Cited

U.S. PATENT DOCUMENTS

| | | | | | |
|---|---|---|---|---|---|
| 2,435,668 | A * | 2/1948 | Behringer | A43B 5/00 | 36/11.5 |
| 2,438,711 | A * | 3/1948 | Leach | A43B 3/24 | 36/101 |
| 2,510,236 | A * | 6/1950 | Kutcher | A43B 3/24 | 36/11.5 |
| 2,680,309 | A * | 6/1954 | Peterson | A43B 3/122 | 36/11.5 |
| 3,925,915 | A * | 12/1975 | Colli | A43B 3/103 | 36/11.5 |
| 4,366,633 | A * | 1/1983 | Flottorp | A43B 7/32 | 36/101 |
| 7,272,897 | B2 * | 9/2007 | Yu | A43B 1/0036 | 36/100 |
| 7,987,617 | B2 * | 8/2011 | Kohatsu | A43B 3/14 | 36/1 |
| 8,051,581 | B2 * | 11/2011 | Aveni | A43B 3/103 | 36/12 |
| 8,516,719 | B2 * | 8/2013 | Aveni | A43B 3/105 | 36/12 |
| 2005/0097781 | A1 | 5/2005 | Greene | | |
| 2005/0132616 | A1 * | 6/2005 | Yu | A43B 1/0036 | 36/100 |
| 2006/0248753 | A1 * | 11/2006 | Welsh | A43B 3/244 | 36/101 |
| 2008/0072451 | A1 * | 3/2008 | Mizrahi | A43B 1/0045 | 36/2.6 |
| 2009/0183392 | A1 * | 7/2009 | Shane | A43B 3/26 | 36/97 |
| 2009/0313851 | A1 * | 12/2009 | Spinelli | A43B 3/24 | 36/15 |
| 2011/0283564 | A1 * | 11/2011 | Stillwagon | A43B 3/122 | 36/101 |
| 2019/0116936 | A1 * | 4/2019 | Aceves Tinajero | A43B 3/0036 | |

* cited by examiner

COMPONENT SHOE

TECHNICAL FIELD OF THE INVENTION

The present invention refers to a footwear having several components, which can be assembled together by the user. In particular, the present invention refers to a footwear wherein the upper can be assembled to a sole by a suitable attachment system.

The present invention also refers to a method for assembling a footwear.

STATE OF THE PRIOR ART

Conventional shoes, present on the market, are composed by a sole and an upper. The upper is fixedly connected to the sole and therefore each shoe has a specific design, is made from pre-determined material and is a product that is sold and conceive as a unit. Therefore, the user is not able to customize the conventional footwear he finds on the market, as he has not the possibility to associate a desired upper with a certain sole, according to his desires.

Moreover, if a shoe is damaged, for example on the sole or on the upper, the user has to throw away the entire shoe. In this way, he has to spend money for new shoes and it is a wastefulness also from an environment point of view.

The application n. DE2523299 discloses a shoe consisting of a sole (3) and an upper (1) suitable to be constrained to the sole. In particular, the upper is pre-shaped and comprises holes while the sole comprises connection elements or eyelets which are inserted in the holes of the upper. This releasable connection between the upper (1) and the sole (3) is attached to the side edge of the sole.

The application n. US2005/097781 discloses a shoe (10) with a portion for housing the food (20) and a sole portion (30). The portion for housing the foot (20) is pre-shaped and comprises a covering portion (21) and a supporting portion (22), as well as several attachment elements or eyelets (23a-23f) on the upper suitable for engaging with the sole (30) on respective attachments means (33a-33f).

The specific structure of attachment elements (23a-23f and 33a-33f) may vary considerably within the scope of the present invention to include snap or button-type fasteners (as shown below), hook and pile fastening systems, magnetic fasteners, or other mechanical fasteners, for example.

The international application n. WO2014/071964 discloses a shoe (1) which comprises a sole element (2) and an upper (3), wherein the sole element (2) and the upper (3) are held together by a cable-form connecting element (4) being guided through eyelet-like or tubular portions (5, 6) on the sole element (2) and on the upper part (3).

Therefore, there is the need of new footwears that allow the user to customize them and also that are more ecological and environmentally-friendly.

SUMMARY OF THE INVENTION

One object of the present invention is to improve the state of the prior art.

A further object of the present invention is to provide a footwear having a sole and an upper, where the upper can be associated with the sole by the user.

A further object of the present invention is to provide a footwear that allows the user to freely choose the footwear's components on the base of his style or on the base of weather condition or else on the base of the place where he has to wear it.

A further object of the present invention is to provide a footwear that allows the user to replace a damaged footwear's component without the need to replace the entire footwear, thus saving money and preserving the environment.

Therefore, the main objects of the present invention are to provide a footwear customizable and also environmentally-friendly.

In accordance with one aspect of the present invention, a footwear is provided according to the present application.

A further object of the present invention is to provide a method for assembling of a footwear that allows the user to freely select the components of the footwear and attach the selected components on the base of his style, or on the base of weather condition or else on the base of the place where he has to wear the footwear itself.

A further object of the present invention is to provide a method for assembling a footwear that results in a versatile, customizable and environment-friendly footwear.

In accordance with one aspect of the present invention, a method for assembling a footwear is provided according to the present application.

The present application refers to preferred and advantageous embodiments of the invention.

BRIEF DESCRIPTION OF THE DRAWINGS

The characteristics of the invention will be better understood by every man skilled in the art from the following description and from the enclosed drawing tables, given as a non-limiting example, in which:

FIG. 5A shows the top surface of a sole according to the present invention, for example that of

FIG. 2,

DETAILED DESCRIPTION OF THE INVENTION

Figure 1:
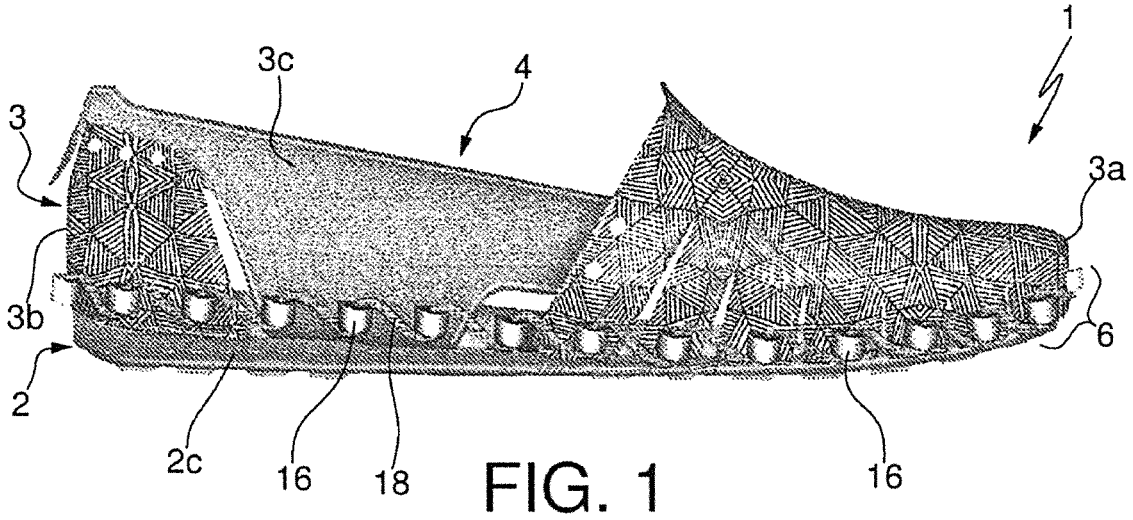
FIG. 1 shows laterally a footwear according to a version of the present invention.
Figure 2:
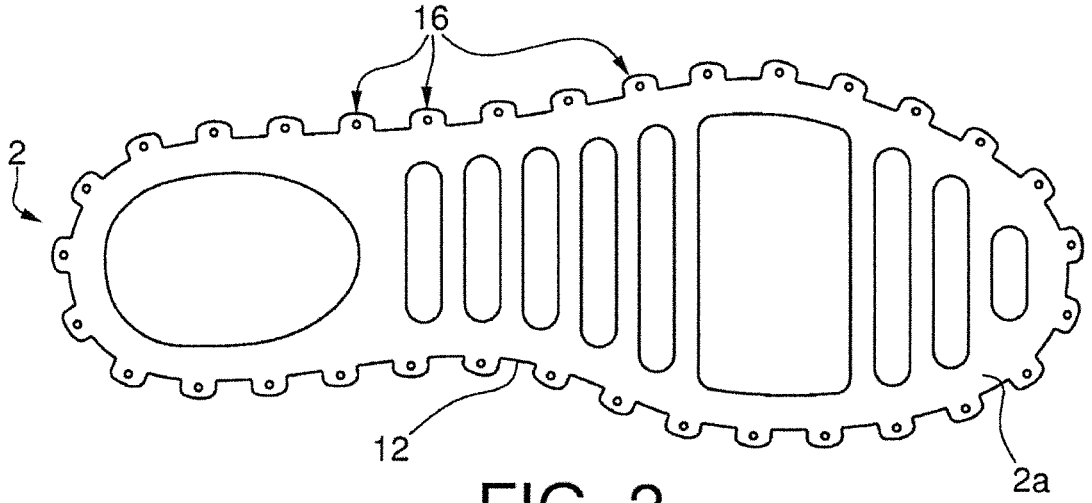
FIG. 2 shows the bottom of a sole of a footwear according to a version of the present invention.
Figure 3:
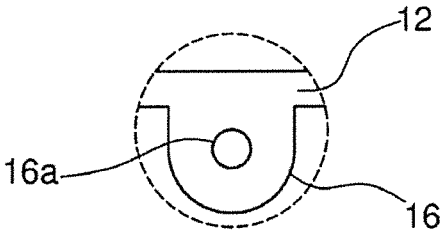
FIG. 3 shows an enlarged detail of the sole of FIG. 2.

The footwear according to the present invention is indicated as a whole with the reference number 1 in the attached drawings.

The footwear 1 is particularly a shoe.

The footwear 1 of the present invention comprises a sole 2 and an upper 3.

The upper 3 is removable attachable to the sole 2 whereby obtaining the footwear 1 according to the present invention.

The footwear 1 further comprises an opening 4, from which the user inserts his foot inside the footwear 1.

During the present description, the word "bottom" refers to a surface or element usually facing the ground or suitable to contact the ground.

The word "top" refers to a surface or element usually facing opposite the ground or oriented towards a direction opposite to the ground.

With "longitudinal" it is meant an axis or direction from the tip to the heel of the footwear while "transversal" means an axis or direction perpendicular to that longitudinal, i.e. from the right side to the left side of the foot inserted in the footwear 1. The sole 2 has a bottom surface 2*a* and a top surface 2*b*.

The bottom surface 2*a* may have a determined pattern or tread, in order to increase the grip to the ground. In fact, the bottom surface 2*a* is suitable for contacting the ground during use. Moreover, the bottom surface 2*a* may comprise one or more inserts, in the same material of the sole 2 or in a different material, suitable to confer specific grip or anti-slip or aesthetic features to the sole 2.

The top surface 2*b* is opposite to the bottom surface 2*a* and is inside the footwear 1.

The sole 2, in an embodiment of the invention, is a cupsole. The sole 2 further comprises a sidewall 2*c*.

The sidewall 2*c* extends from the bottom surface 2*a* of the sole.

The sidewall 2*c* extends towards the top of the footwear 1, in a substantially perpendicular matter with respect to the bottom sole 2*a*.

The sidewall 2*c* extends from and/or is placed and/or determines the outer periphery 12 of the sole 2

The sole 2 has a shape substantially corresponding to the bottom of the foot and the outer periphery 12 substantially corresponds to the outer periphery of the foot itself.

The sole 2 of the footwear 1 is usually made of a rubber material or of a polyurethane (PU) material or of a thermoplastic polyurethane (TPU) or other suitable materials.

When at least one insert is present in the bottom surface 2*a* of the sole 2, such at least one insert is preferably made of rubber, especially when the sole 2 is made in a polyurethane material.

In a version of the invention, the sole 2 comprises a midsole 5. The midsole 5 is at least partially or completely enclosed by the sidewall 2*c*. The midsole 5 has a top surface 5*a* which is suitable to contact the bottom surface of the user's foot or that faces the user's foot.

In another version of the invention, the sole 2 does not comprise a midsole 5 and the top surface 2*b* of the sole 2 is suitable to contact the bottom surface of the user's foot or that faces the user's foot.

The midsole 5, when present, is made of ethyl-vinyl-acetate, polyurethane or similar suitable materials allowing the comfort and the support for the foot.

The midsole 5 may be cemented or molded in the sole 2 or fixed to the sole 2 by a suitable technique.

In another version, the material composing the midsole 5, in a fluid state, is poured inside the sole 2, in particular in the space contained by the bottom surface 2*a* and the sidewall 2*c* of the sole 2 and then let setting or curing inside it until it reaches a solid state.

In a further version, the midsole 5 drops in the sole 2 and it is not molded in or cemented in the latter.

The upper 3 in a version of the invention is a single piece of material shaped, during use, to at least substantially wrap the foot of the user.

In a further version of the invention (for example shown in FIGS. 1 and 13), the upper is made from at least two parts. In such an example, the upper 3 is composed by a tip or front portion 3*a*, suitable to cover the fore-foot portion of the foot, a heel portion 3*b*, suitable to encircle the heel of the foot, and one or two side portions 3*c*.

The tip or front portion 3*a* is connected to the side portion/s 3*c* and the side portion/s 3*c* is/are connected to the heel portion 3*b*.

This kind of connection is made with suitable connection means, such as screws, pins, clips, buttons, etc. In another version of the invention, this kind of connection is made with suitable connection means, such as seams or stitching.

Figure 12B:
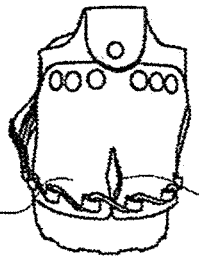
FIGS. 12A, 12B, 12C show a footwear according to the invention respectively from a perspective point of view, from the rear and a side view.
Figure 12A:
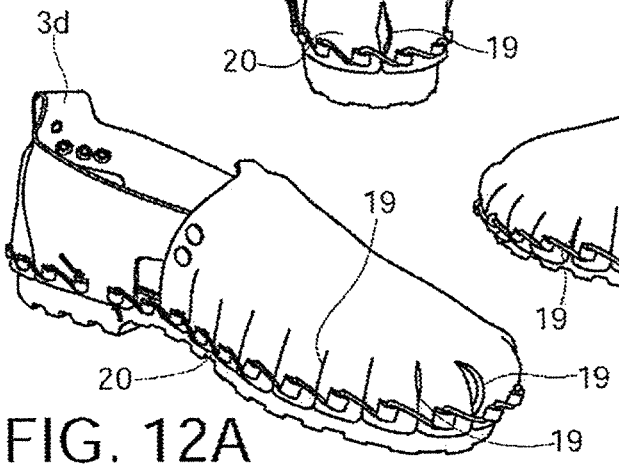
Figure 12C:
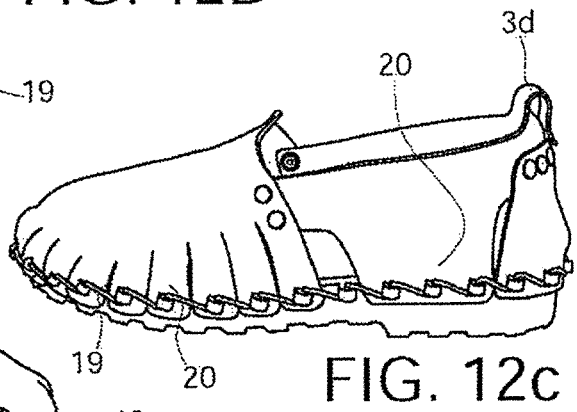

For example in FIGS. 12 and 13, it is possible to see that the tip or front portion 3*a* is connected to the side portion 3*c* (that in this case is a single piece having an elongate shape similar to a sort of bridge) at first connection points 3*a*1, 3*c*1.

The first connection points 3*c*1 are placed laterally to the elongate shape of the side portion 3*c*.

The side portion 3*c*, when shaped and connected to at least the tip or front portion 3*a*, has a C shape. The convexity of the C-shape is directed towards the heel portion of the footwear.

The connection points may comprise one or more holes or corresponding holes, suitable to put together two elements or portions of the present invention, for example through suitable connection means, such as screws, pins, clips, buttons, etc., possibly suitable to be engaged or housed inside such one or more holes.

As can be seen in FIGS. 12 and 13, the footwear according to the present invention comprises also a heel portion 3*b* that is connected to the side portion 3*c* at second connection points 3*c*2, 3*b*2.

The second connection points 3*c*2, 3*b*2 are placed centrally, with respect to the heel portion 3*b* and the side portion 3*c*. In particular, the second connection points 3*c*2, 3*b*2 are placed in the top portion, during use, of such components of the footwear or at least the second connection points 3*b*2 are placed in the top portion of the heel portion 3*b*.

The during use top portions or surfaces of the footwear according to the present invention, as will better disclosed hereafter, are faced towards an edge 13 of the opening 4 of the upper 3.

Figure 13A:
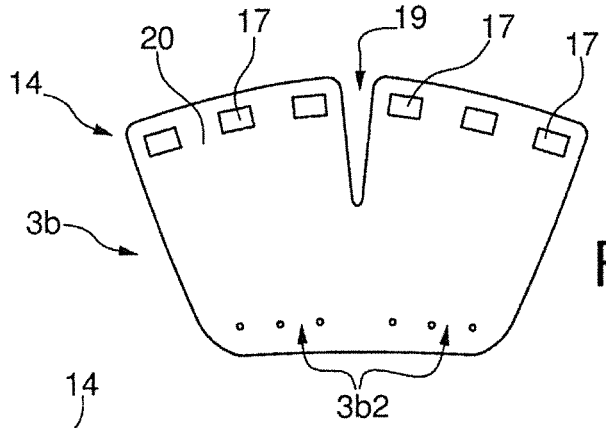
FIGS. 13A, 13B, 13C show one version of the upper of a footwear according to the invention in a flattened shape.
Figure 13B:
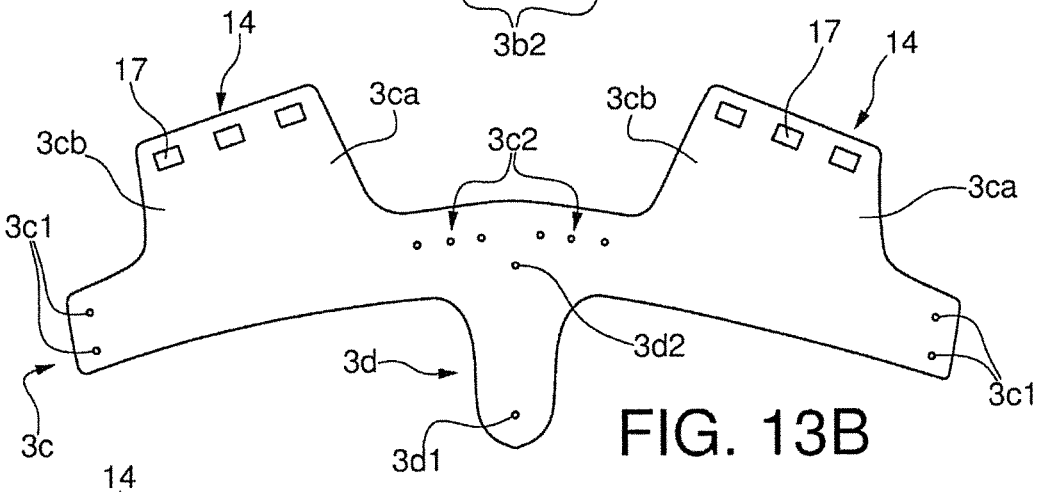
Figure 13C:
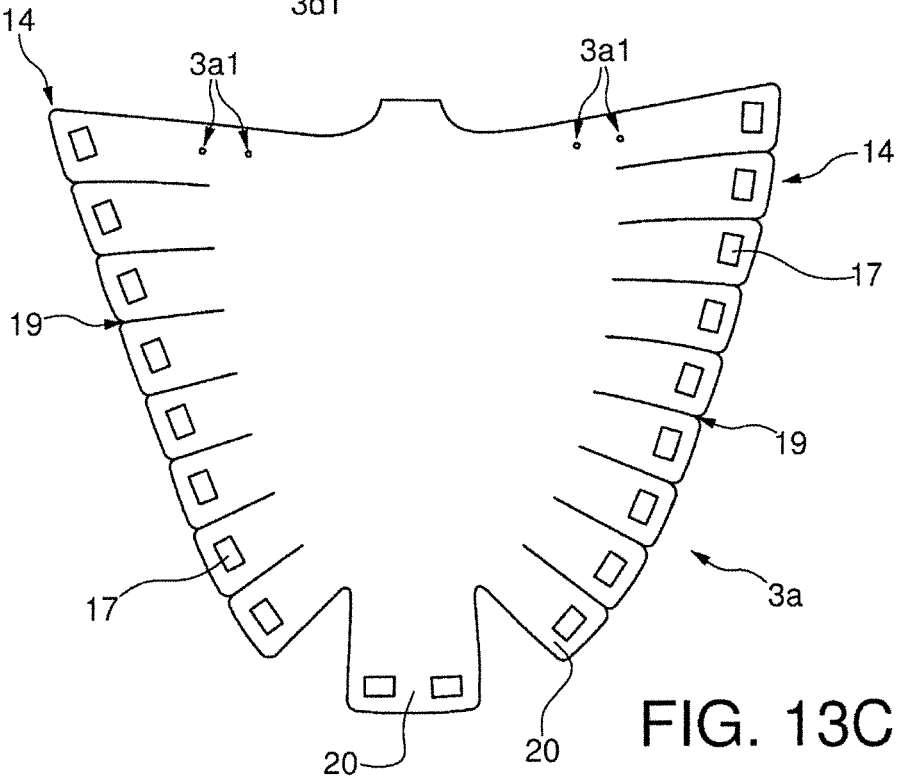

In its flattened shape, as visible in FIGS. 13A and 13C, the heel portion has a substantially rectangular, square, trapezoidal or substantially circular configuration.

As said, the top portion during use of the heel portion 3*b* is interested by the second connection points 3*b*2 while the bottom during use portion thereof corresponds to a bottom edge 14 of the upper 3 and/or in interested by the presence of a plurality of holes 17 of an attachment system 6, as better disclosed hereafter.

As visible from FIG. 13B, the side portion 3*c* may also comprise a rear tongue element 3*d*. The rear tongue element 3*d* will, during use, constitute a rear tongue for the footwear 1.

The rear tongue element 3*d* may be already shaped as a rear tongue or may have to be shaped to constitute the final rear tongue of the footwear 1. For example, the rear element 3*d* may have a substantially elongate configuration, with a length about the double of the length of the final rear tongue, and has to be fold back on itself to reach the final configuration. In this latter case, third connection points 3*d*1, 3*d*2 may be present. For example, there are at least two third connection points 3*d*1, 3*d*2, one of them (3*d*1) is placed at the peak of the rear tongue element 3*d*, at a greater distance from the side portion 3*c* with respect to the other third connection point (3*d*2). The other third connection point (3*d*2) is placed near the second connection points 3*c*2, 3*b*2, in the side portion 3*c* and/or in the heel portion 3*b*. in this way, the position of the third connection points 3*d*1, 3*d*2 allows the folding back of the rear tongue element 3*d*, connecting in a constrained way its folding.

The side portion 3*c* may also comprise one or two intermediate extensions 3*ca*, 3*cb*.

The intermediate extension 3*ca*, 3*cb* are placed one opposite to the other with respect to the rest tongue 3*d*.

The intermediate extensions 3*ca*, 3*cb* are placed near the side ends of the side portion 3*c*, possibly in a symmetric manner with respect to the symmetry transversal plane of the side portion 3*c*.

The intermediate extensions 3*ca*, 3*cb* are, in at least one version thereof, placed laterally with respect to a space in use occupied by the heel portion 3*b* and/or to the heel portion 3*b*.

During use, the intermediate extensions 3*ca*, 3*cb* extend from the side portion 3*c* towards the sole 2 of the footwear 1 at a distal end thereof. The distal end of the intermediate extensions 3*ca*, 3*cb* and/or the intermediate extensions 3*ca*, 3*cb* comprise at least a part of the bottom edge 14 of the upper 3 and/or a plurality of holes 17 of an attachment system 6, as better disclosed hereafter.

The tip or front portion 3*a*, as visible from FIG. 13*c*, in its flattened shape has a substantially semicircular or semi-oval conformation, with a substantially flat side in use towards the opening 4 of the upper 3, or towards the heel portion 3*b*.

The upper may be made also only by two portions or from a number higher than three of portions, according to the specific design and purpose of the footwear 1 including such upper's portions.

Taken together, the portions 3*a*, 3*b* and 3*c* reproduce during use the shape of a conventional upper of a shoe.

As previously said, the upper 3 delimits during use an opening 4 for foot insertion. The edge 13 of the upper 3 delimiting the opening 4 is substantially circular shaped. Such edge may be composed by the respective edges of the portions 3*a*, 3*b*, 3*c* constituting the upper 3 in such specific embodiment. The edge 13 is the top edge of the upper 3.

The upper 3 may be made of any suitable material, for example leather, textile, synthetic material or mixture thereof.

The upper 3 further comprises a bottom edge 14, facing towards the sole 2 or the ground. The bottom edge 14 substantially corresponds to the outer periphery 12 of the sole 2. During use, when the upper 3 is attached to the sole 2, the bottom edge 14 corresponds and/or is over to the outer periphery 12 of the sole 2.

The footwear 1 according the present invention further comprises an attachment system 6.

The attachment system 6 has the aim to attach the sole 2 and the upper 3 at the area of the outer periphery 12 of the sole 2 and the bottom edge 14 of the upper 3.

More in detail, the attachment system 6 comprises a plurality of lugs 16.

Each lug 16 is a sort of projection or bump that extends outwardly or protrude from the sidewall 2*c* of the sole 2.

Each lug 16 is substantially perpendicular to the sidewall 2*c*.

The lug 16 has a substantially rectangular or circular shape departing from the sidewall 2*c*.

Furthermore, each lug 16 includes a through-opening 16*a*.

The through-opening 16*a* has a substantially top-down direction; more particularly, the through-opening 16*a* has a development substantially sloping or perpendicular with respect to the bottom surface 2*a* of the sole 2.

In a version of the invention, the through-opening 16*a* has a vertical development, considering the footwear 1 resting on the ground at the bottom surface 2*a*.

The plurality of lugs 16 (called also "side lugs") are preferably made of rubber, for example the same rubber type of which the sole 2 is made, in a version of the invention. The lugs 16 may also be made from other suitable material, allowing them to perform their aim.

In a version of the invention, the lugs 16 are part of the sole 2, i.e. are molded or realized in a single step or as a single body with the sole 2.

Figure 9:
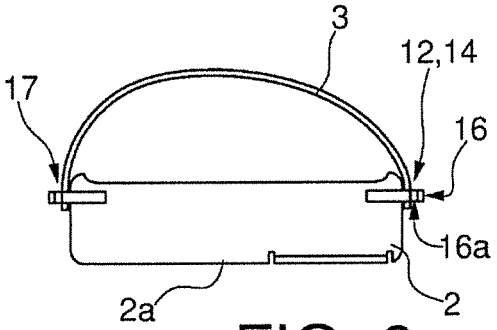
FIG. 9 shows a transversal section of the footwear of FIG. 8, taken along the plane IX of FIG. 8.
Figure 8:
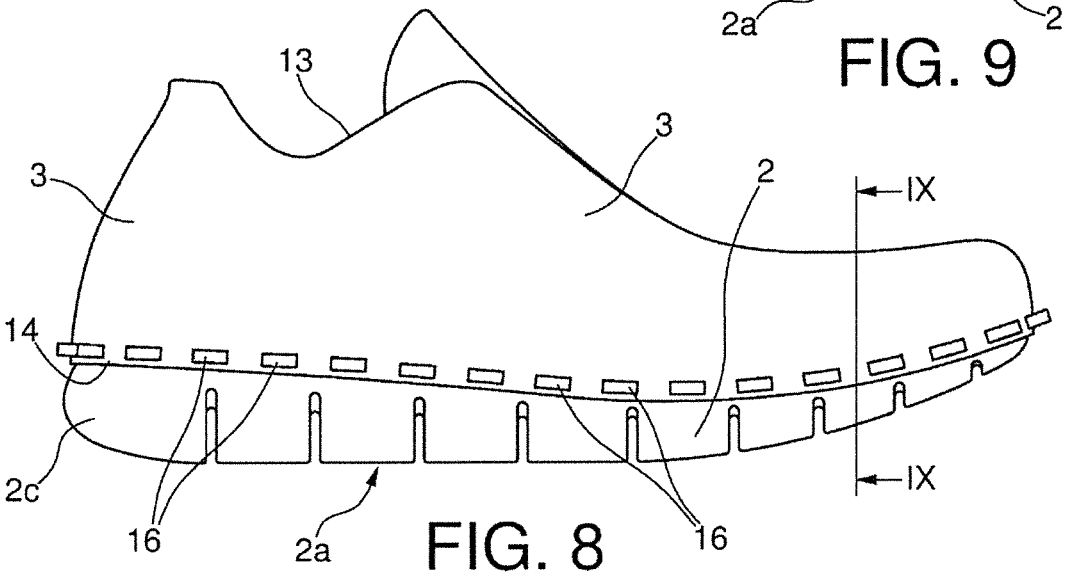
FIG. 8 shows a lateral view of a version of a footwear according to the present invention.
Figure 10:
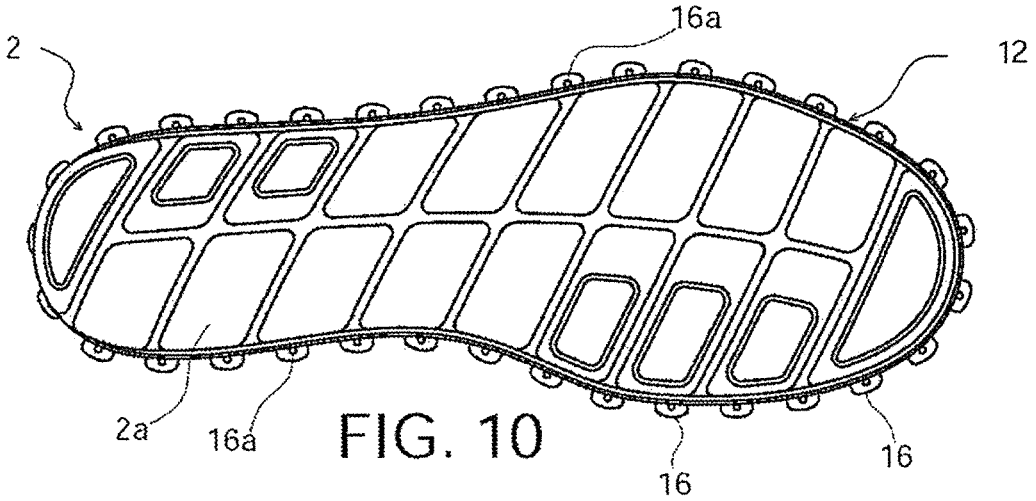
FIG. 10 shows the bottom on a version of a sole according to the present invention, for example that of FIGS. 8 and 9.

In a version of the invention, the sole 2 is composed of a sole of a first material, for example molded polyurethane, with lugs 16 of a second material, for example rubber, wherein the lugs 16 are inserted in or attached to the sole 2, particularly inserted in or attached to the sidewall 2*c* (as shown in FIG. 9). In this version of the invention, the midsole 5 may not be present and the sole 2 is realized as a whole, i.e. the sole 2 directly comprises also the midsole in a single piece of material, comprising a top surface 2*b* for contacting with the user's foot.

For example, in a further version of the invention, the sole 2 is realized as a one-piece soling unit, where a chassis, comprising a plurality of lugs 16, is placed in a mold where a PU or a material of the sole 2 is poured in. The chassis, comprising the lugs 16, therefore, becomes an integral part of the soling unit or sole 2.

The chassis may be die cut or molded and/or it may be made of PU, TPU, rubber or other materials.

In a version of the invention, the through-opening 16*a* are realized during the realization or molding step of the lugs 16.

In another version of the invention, the through-opening 16*a* are realized after the realization or molding step of the lugs 16, for example by piercing the latter through a suitable tool.

The attachment system 6 further comprises a plurality of holes 17—as said above—made in the upper 3. The holes 17 are matching with the plurality of lugs 16, both in terms of position and of shape.

The holes 17 are suitable to engage with the lugs 16.

The holes 17 are realized at the bottom portion of the upper 3, in the vicinity of the bottom edge 14.

Each hole 17 has a substantially rectangular or circular shape, corresponding to the substantially rectangular or circular shape of the lug 16.

In fact, the lug 16 is inserted in the hole 17 or fits inside it, in order to attach the upper 3 to the sole 2.

Each hole 17 is a sort of buttonhole for the lug 16.

Such attachment is a removable or reversible connection.

In this way, the upper is attached in a removable way to the sole and therefore the user can select the sole or the upper (or the portion of the upper) in order to customize his footwear or to repair only the damaged portion of his footwear.

The bottom portion of the upper 3, where there are the holes 17, covers and/or is over the portion of the sidewall 2*c* where the lugs 16 are present.

Correspondingly, holes 17 fit over side lugs 16.

The plurality of lugs 16, and correspondingly the plurality of matching holes 17, is placed at the outer periphery 12 of the sole, i.e. along its profile.

The lugs 16 may be spaced apart the one with respect to the other along the whole sidewall 2*c*. Otherwise, the lugs 16 may be present or grouped only in specific traits of the sidewall 2*c*, where due to stresses arising during use of the footwear 1 there is a greater need of attachment with the upper 3.

Obviously, holes 17 reflects the position of lugs 16.

In a version of the invention, the holes 17 are realized by die cutting or piercing or cutting of the upper 3.

In order to do not be damaged, the lugs are realized aiming at minimizing bulk and/or weight of the footwear 1. Therefore, the size of the lugs is suitable to realize the attachment with the upper but keeping attention that this does not makes the footwear 1 unpractical to use.

In order to confer a surer attachment of the sole 2 and the upper 3, the attachment system 6 further comprises a safe attachment element.

In a version of the invention, the safe attachment element comprises a lace-like element 18.

Once the lugs 16 are inserted into the holes 17 of the upper, and the upper 3 is therefore connected with the sole 2, the lace-like element 18 is passed through the through-openings 16*a* of the lugs 16 to ensure that the upper 3 does not come off the lugs 16.

The lace-like element 18 may be a thin cord or string. In a version of the invention, it has rigid tips on both ends to facilitate passing it through the holes or through-openings 16*a* of the side lugs 16. The cord or string may be made of leather or a synthetic material.

In a version of the invention, the cord or string is finished by knotting its ends together or by the use of a clamp.

The lace-like element 18 may be also defined a connecting string. In a version of the invention, the lace-like element 18 is laced through the lugs 16.

In another version of the invention, the safe attachment element comprises a series of pegs or connected pegs (not shown); such pegs or connected pegs would go or be inserted into the through-openings 16*a* of the lugs 16.

The pegs could be used instead of the lace-like element or, in a version of the invention together with the lace-like element for better certainty of connection between the sole 2 and the upper 3.

In a version of the invention, the upper 3, before it is attached to the sole 2, has a flat or flattened conformation (as shown in FIGS. 13A, 13B, 13C).

In another version, the upper 3 is pre-shaped.

In the version where the upper 3 has a flat conformation, it is shaped, in a sort of 3D shape, conforming the natural shape of the foot, when the user attaches the upper 3 to the sole 2 through the attaching system 6.

Figure 11:
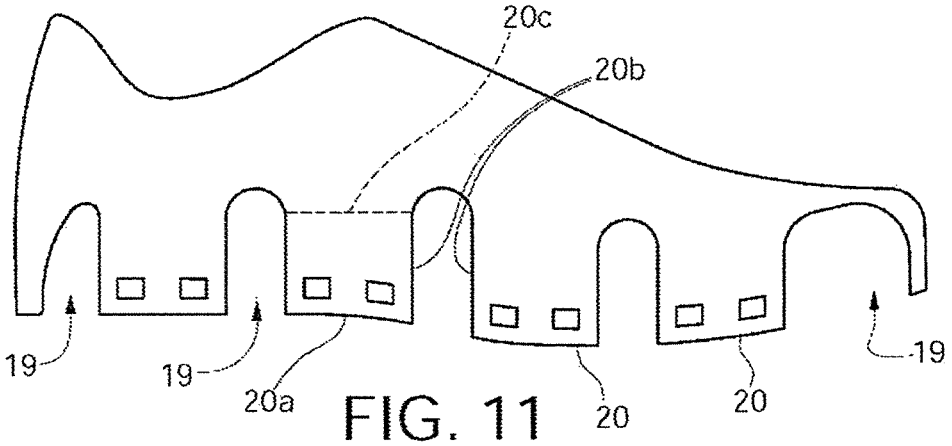
FIG. 11 shows a version of the upper according to the invention.

In particular, according to the examples shown in FIGS. 11, 12A, B and C and 13A, B, C, the upper 3 has a flat configuration and, in order to assume its 3D final shape, it is realized with a series of cuts or splits 19.

In particular, such cuts or splits 19 are made or placed at the bottom edge 14 of upper 3.

Such cuts or splits 19 are oriented towards the inner area or central portion of the upper 3, possibly towards the opening 4 of the same.

In a version of the invention, such cuts or splits 19 are present also when the upper has a pre-determined shaped or 3D configuration.

In this way, during the attachment steps of the upper 3 to the sole 2, the cuts or splits 19 allows the user to fold the upper 3 in order to become a 3D shape from a flat shape for the upper 3.

The cuts or splits 19 determine a corresponding series of wings 20 of upper 3. The wings 20 departs from a central portion of the upper placed substantially around the opening 4 for the foot insertion. For a first trait, the central portion of the upper is continuous and entire.

After this first trait, the wings 20 departs from such central portion and are separate the one by the other by the cuts or splits 19.

Therefore, the upper 3 having a flat configuration comprises a series of cuts or splits 19 and a corresponding series of wings 20, at the bottom edge 14 of the upper 3, separated the one to the other by the cuts or splits 19.

In other words, each wing 20 may have a substantially rectangular conformation, having a base trait 20*a* corresponding to a portion of the bottom edge 14 of the upper 3 and two sides 20*b* defined by or determined by or corresponding to the cuts or splits 19. Each wing 20 further comprises a second trait 20*c*, parallel to the base trait 20*a*, that is connected or realized as a whole with the central portion or remaining portion of the upper.

The two sides 20*b* are substantially parallel the one with respect to the other, and/or substantially perpendicular to the base trait 20*a* or substantially converging towards the base trait 20*a*.

In this case, the bottom edge 14 of the upper 3 is not continuous and it is realized by the series of base traits 20*a* of the wings 20.

These wings may be present also when two or more portions compose the upper 3.

For example, the wings 20 can be present in the heel portion 3*b* and/or in the tip or front portion 3*a* and/or in the side portion 3*c* and/or in the intermediate extensions 3*ca*, 3*cb* of the side portion 3*c*.

Again, there wings 20 may be present only at certain portion of the footwear, for example at the front and/or rear portions of the footwear, where the upper 3 has a greater curvature or 3D structure.

For example, the splits 19 in the tip area of the tip or front portion, i.e. in the area corresponding to the tip of the footwear, the splits 19 may have a greater width than splits 19 placed in other parts of the footwear 1, as in this area the upper 3 needs to be shaped or folded with a great curvature than in other parts, in order to compliant with the shape of the user's foot.

Otherwise, in another version, such wings may not be present in lateral portions of the upper, because such portions are substantially flat, and therefore in such areas the flat upper does not need to be shaped.

Near the base trait 20*a*, one or more holes 17 are present also in the wigs 20, for engagement with respective lugs 16 of the sole 2.

Figure 4:
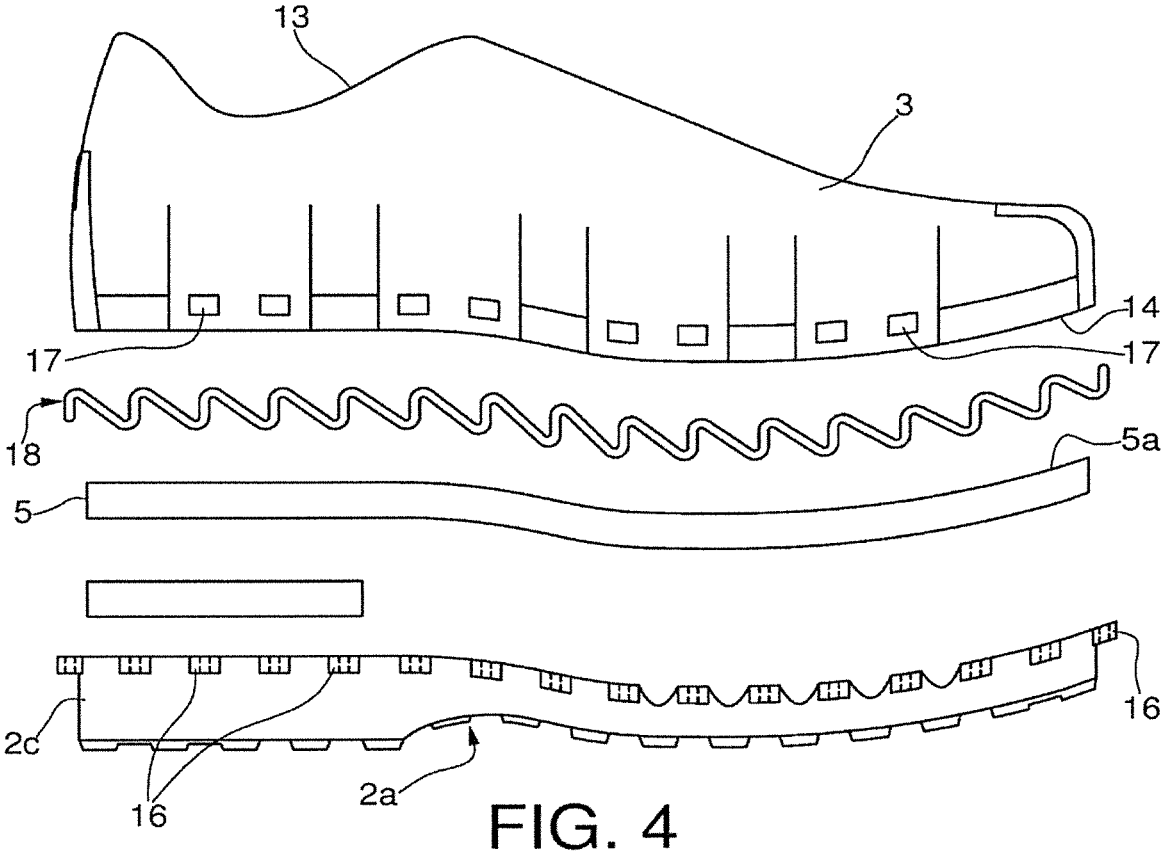
FIG. 4 shows an exploded view of a version of the footwear according to the invention.
Figure 5A:
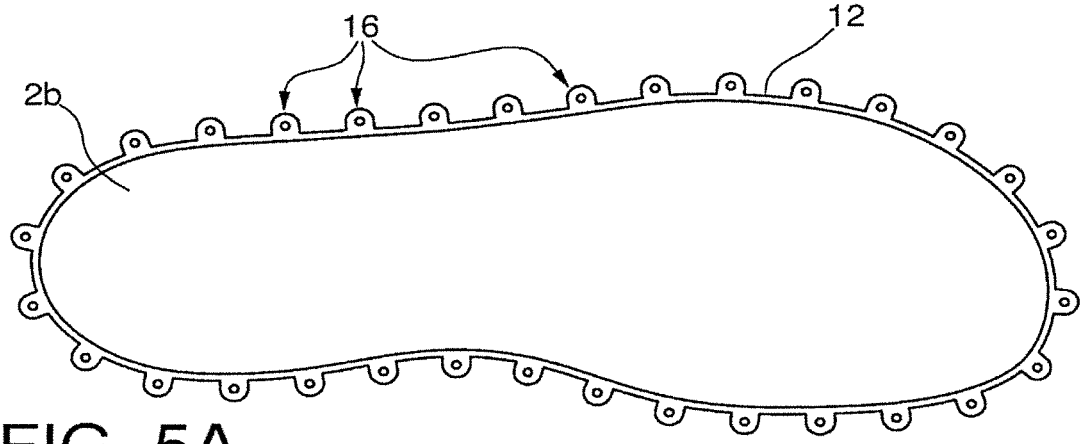
Figure 5B:
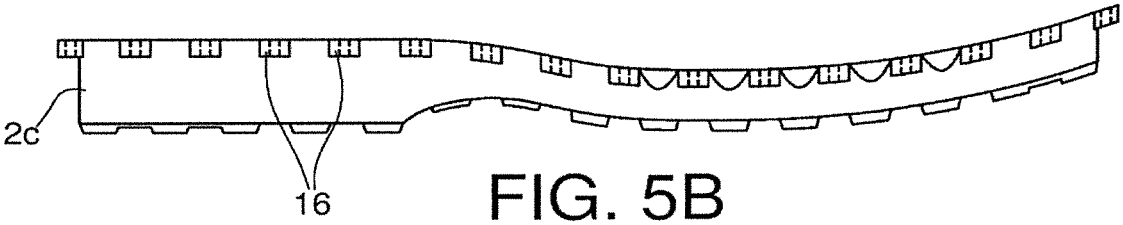
FIG. 5B shows the lateral view of the sole of FIGS. 4 and 5A.
Figure 7:
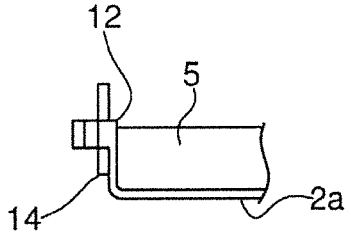
FIG. 7 shows an enlarged detail of the attachment system of the present invention.
Figure 6:
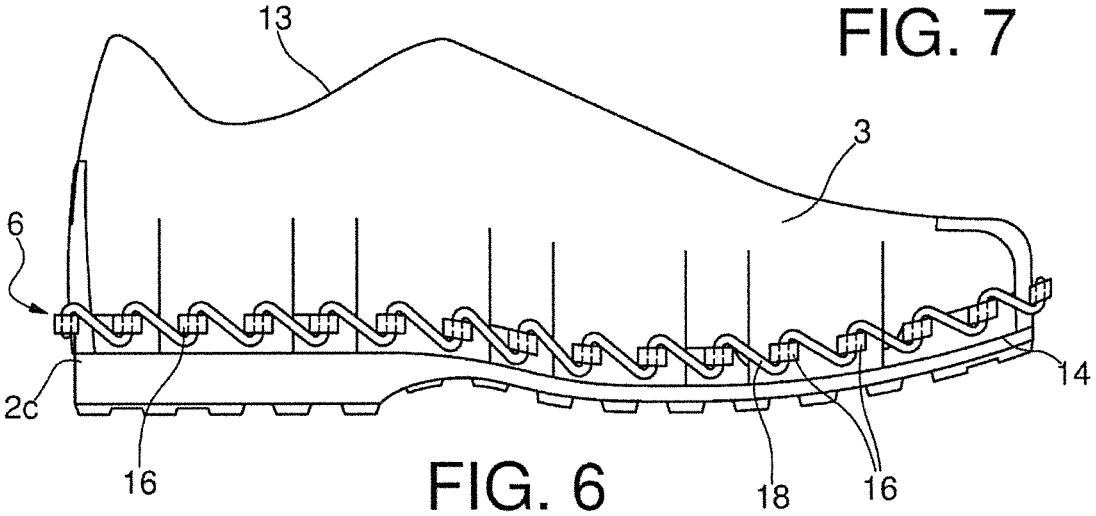
FIG. 6 shows the assembled footwear of FIG. 4.

In a version of the invention, as shown in FIG. 4, the midsole 5 may comprise a first midsole portion, which development substantially corresponds to the bottom of the foot, and a second midsole portion placed in the heel area, namely a heel midsole portion. In this way, the midsole 5 in the area of the heel has a height that is greater than the height of the midsole 5 at the from area.

The present invention also discloses a method for assembling of a footwear.

This method comprises the steps of providing a sole 2 comprising a bottom surface 2*a*, suitable for contacting the ground during use, and a sidewall 2*c* that extends from the bottom surface 2*a* and is placed at the outer periphery 12 of the sole 2, providing an upper 3, removably attaching the upper 3 to the sole 2, thus obtaining the footwear 1.

The method comprises also a step of providing an attachment system 6 suitable to removably attach the upper 3 to the sole 2.

The step of providing the attachment system 6 comprises providing a plurality of lugs 16, placed in the sole 2 and extending outwardly from the sidewall 2*c*, providing a plurality of holes 17, placed in the upper, wherein the holes 17 are placed near a bottom edge 14 of the upper 3, wherein the bottom edge 14 is facing towards the sole 2, placing the upper 3 substantially over the sole 2 and the holes 17 substantially over the lungs 16, engaging the holes 17 with the plurality of lugs 16, for example inserting each lugs 16 inside a corresponding hole 17 and thus attaching the upper 3 to the sole 2.

The method according to the invention further comprises the steps of providing a safe attachment element, wherein the safe-attachment element comprises a lace-like element 18 and/or at least one peg element, and lacing and/or inserting and/or passing the lace-like element 18 and/or the at least one peg element through the through-openings 16*a* provided in each lug 16.

Moreover, in a version of the invention, the method comprises the step of providing a midsole 5, inserting the midsole 5 inside the sole 2 and/or inside the sidewall 2*c* by cementing or molding the midsole 5 in the sole 2 or fixing the midsole 5 to the sole 2 by a suitable technique or pouring or dropping the material composing the midsole 5, in a fluid state, inside the sole 2, and then letting setting or curing the midsole 5 inside the sole 2 until it reaches a solid state.

The previously disclosed step of providing the upper 3 comprises, in a version of the invention, the steps of providing at least two parts of the upper 3, for example a tip or front portion 3*a*, suitable to cover the fore-foot portion of the foot, a heel portion 3*b*, suitable to encircle the heel of the foot, and/or one or two side portions 3*c*, connecting together such portions to determine the final in use shape of the upper 3, for example connecting the tip or front portion 3*a* to the side portion/s 3*c* and the side portion/s 3*c* to the heel portion 3*b*.

In a further version, alternative or in addition to the previous one, the step of providing the upper 3 comprises the steps of providing the upper 3 having a flat configuration, wherein the upper 3 comprises a series of cuts or splits 19 and a corresponding series of wings 20, at the bottom edge 14 of the upper 3, separated the one to the other by the cuts or splits 19, wherein each wing 20 has a substantially rectangular conformation, having a base trait 20*a* corresponding to a portion of the bottom edge 14 and two sides 20*b* defined by the cuts or splits 19, folding or curving the wings 20 and/or getting close a first wing 20 to the nearer or a second wing 20 in order to give the upper 3 a curved or shaped configuration, suitable to cover at least a part of the foot, getting near and/or place side by side the base traits 20*a* of at least two wings 20, in order to make the bottom edge 14 substantially continuous in at least a portion, engaging the holes 17 provided in each wing 20 with the plurality of lugs 16, for example inserting each lugs 16 inside a corresponding hole 17 and thus attaching the upper 3 to the sole 2.

As is evident from the above description, the present invention meets the previously-indicated advantages.

Indeed, by means of this method, it is possible to simply and quickly obtain a footwear that is customizable and environment-friendly because it allows the user to freely choose the footwear's components on the base of his style or desires and, optionally, to replace a damaged footwear's component without the need to replace the entire footwear.

The invention thus conceived is susceptible of numerous modifications and variants, all falling within the scope of the inventive concept.

In addition, the characteristics described for one embodiment of the invention can also be present in other embodiments, without departing from the protective scope of the present invention.

In addition, all details can be substituted with other technically equivalent elements. In practice, all employed materials, as well as the contingent shapes and sizes, can be of any type in accordance with requirements, without departing from the protective scope of the following claims.

The invention claimed is:

1. A footwear comprising a sole and an upper, wherein the sole comprises a bottom surface, for contacting the ground during use, and a sidewall that extends from the bottom surface and is placed at the outer periphery of the sole, wherein the upper is removable attachable and/or attached to the sole, wherein the footwear comprises an attachment system suitable to removably attach the upper to the sole, wherein said attachment system comprises a plurality of lugs affixed to the sole and extending outwardly from the sidewall, and a plurality of holes in the upper, wherein the holes are configured to engage with the plurality of lugs, wherein the upper has a flat configuration that when attached to the sole, wraps the foot of the user, wherein each lug includes a through-opening, wherein the through-opening has a top-down direction, and/or the through-opening is sloping or perpendicular with respect to the bottom surface of the sole and/or the through-opening is in a vertical direction when the bottom surface of the footwear is resting on the ground.

2. The footwear according to claim 1, wherein said holes are placed near a bottom edge of the upper, wherein said bottom edge is facing towards the sole.

3. The footwear according to claim 1, wherein the holes have a shape matching the shape of the plurality of lugs, including a rectangular shape or circular shape.

4. The footwear according to claim 1, wherein the footwear or the attachment system further comprises an attachment element, wherein the attachment element comprises a lace element and/or at least one peg element, wherein the attachment element is laced and/or inserted through the through-openings of the lugs.

5. The footwear according to claim 1, wherein the sole is made of a rubber material or of a polyurethane (PU) material or of a thermoplastic polyurethane (TPU) and/or wherein the upper is made of leather, textile, synthetic material or mixture thereof, and/or comprising a midsole, wherein the midsole is at least partially enclosed by the sidewall of the sole, and/or wherein the midsole is made of ethyl-vinyl-acetate (EVA), polyurethane (PU) allowing the comfort and the support for the user's foot during use.

6. The footwear according to claim 1, wherein the upper is a single piece of material shaped, during use, to at least wrap the foot of the user or wherein the upper is made from at least two parts, including a tip or front portion, to cover the fore-foot portion of the foot, a heel portion, to encircle the heel of the foot, and/or one or two side portions, wherein said portions are connected together to determine the upper.

7. The footwear according to claim 2, wherein the upper comprises a series of cuts or splits and a corresponding series of wings, at the bottom edge of the upper, separated the one to the other by said cuts or splits, wherein each wing has a rectangular conformation, having a base corresponding to a portion of the bottom edge and two sides defined by the cuts or splits.

8. A method for assembling a footwear comprising a sole and an upper, wherein the sole comprises a bottom surface, for contacting the ground during use, and a sidewall that extends from the bottom surface and is placed at the outer periphery of the sole, wherein the upper is removable attachable and/or attached to the sole, wherein the footwear comprises an attachment system suitable to removably attach the upper to the sole, wherein said attachment system comprises a plurality of lugs affixed to the sole and extending outwardly from the sidewall, and a plurality of holes in the upper, wherein the holes are configured to engage with the plurality of lugs, wherein the upper has a flat configuration that when attached to the sole, wraps the foot of the user, wherein each lug includes a through-opening, wherein the through-opening has a top-down direction, and/or the through-opening is sloping or perpendicular with respect to the bottom surface of the sole and/or the through-opening is in a vertical direction when the bottom surface of the footwear is resting on the ground, the method comprising the steps of:

providing a sole comprising a bottom surface for contacting the ground during use, and a sidewall that extends from the bottom surface and is placed at the outer periphery of the sole, providing an upper, wherein the upper has a flat configuration, which, when attached to the sole, at least wraps the foot of the user, comprising the step of providing an attachment system to removably attach the upper to the sole, wherein said step of providing the attachment system comprises:

providing a plurality of lugs affixed to the sole and extending outwardly from the sidewall, providing a plurality of holes in the upper, wherein said holes are placed near a bottom edge of the upper, wherein said bottom edge is facing towards the sole, placing the upper over the sole and the holes over the lugs, engaging the holes with the plurality of lugs, including inserting each lug inside a corresponding hole and thus attaching the upper to the sole, and removably attaching the upper to the sole.

9. The method according to claim 8, comprising the steps of:

providing a attachment element, wherein the attachment element comprises a lace element and/or at least one peg element, lacing and/or inserting and/or passing the lace element and/or the at least one peg element through a through-openings provided in each lug.

10. The method according to claim 8, comprising the steps of:

providing a midsole, inserting the midsole inside the sole and/or inside the sidewall by cementing or molding the midsole in the sole or fixing the midsole to the sole by a suitable technique or pouring or dropping the material composing the midsole, in a fluid state, inside the sole, and then letting setting or curing the midsole inside the sole until it reaches a solid state.

11. The method according to claim 8, wherein said step of providing the upper comprises providing at least two parts of the upper, including a tip or front portion to cover the fore-foot portion of the foot, a heel portion to encircle the heel of the foot, and/or one or two side portions, connecting together said portions to determine a shape of the upper, including connecting the tip or front portion to the side portions and the side portions to the heel portion.

12. The method according to claim 8, wherein said step of providing the upper comprises the steps of:

providing the upper having a flat configuration or providing the upper, wherein said upper comprises a series of cuts or splits and a corresponding series of wings, at the bottom edge of the upper, separated the one to the other by said cuts or splits, wherein each wing has a rectangular conformation, having a base corresponding to a portion of the bottom edge and two sides defined by the cuts or splits, folding or curving said wings in order to give the upper a curved or shaped configuration, to cover at least a part of the foot, placing side by side the base of at least two wings, engaging the holes provided in each wing with the plurality of lugs, including inserting each of the plurality of lugs inside a corresponding hole and attaching the upper to the sole.

13. An attachment system for removably attaching an upper to a sole of a footwear, the footwear comprising the sole and the upper, wherein the sole comprises a bottom surface, for contacting the ground during use, and a sidewall that extends from the bottom surface and is placed at the outer periphery of the sole, wherein the upper is removable attachable and/or attached to the sole, wherein the footwear comprises an attachment system suitable to removably attach the upper to the sole, wherein said attachment system comprises a plurality of lugs affixed to the sole and extending outwardly from the sidewall, and a plurality of holes in the upper, wherein the holes are configured to engage with the plurality of lugs, wherein the upper has a flat configuration that when attached to the sole, wraps the foot of the user, further comprising a plurality of lugs, placed in the sole and extending outwardly from the sidewall of the sole, and a plurality of holes, placed in the upper, wherein the holes are configured to engage with the plurality of lugs, and an attachment element, wherein each lug has a rectangular or circular shape departing from said sidewall and includes a through-opening, wherein said attachment element comprises a lace element and/or at least one peg element, wherein said attachment element is laced and/or inserted through through-openings of the lugs.

14. A footwear comprising a sole and an upper, wherein the sole comprises a bottom surface, for contacting the ground during use, and a sidewall that extends from the bottom surface and is placed at the outer periphery of the sole, wherein the upper is removable attachable and/or attached to the sole, wherein the footwear comprises an attachment system suitable to removably attach the upper to the sole, wherein said attachment system comprises a plurality of lugs affixed to the sole and extending outwardly from the sidewall, and a plurality of holes formed in the upper, wherein the plurality of holes match the plurality of lugs in position and shape and wherein the plurality of lugs are inserted into the plurality of holes to removably attach the upper with the sole, wherein the upper has a flat configuration that when attached to the sole, wraps the foot of the user, wherein the upper comprises a plurality of cuts or splits made at a bottom edge of the upper and oriented towards an inner area or central portion of the upper, and a plurality of wings at the bottom edge of the upper, each separated by the cuts or splits.

15. The footwear of claim 14, wherein each wing has a rectangular conformation, a base trait corresponding to a portion of the bottom edge and two sides defined by the cuts or splits.

* * * * *